US011195461B2

(12) United States Patent
Jang et al.

(10) Patent No.: US 11,195,461 B2
(45) Date of Patent: Dec. 7, 2021

(54) ELECTROLUMINESCENT DISPLAY DEVICE

(71) Applicant: LG Display Co., Ltd., Seoul (KR)

(72) Inventors: Hyung-Uk Jang, Seoul (KR); Byeong-Seong So, Seoul (KR); Young-Sung Cho, Goyang-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/116,770

(22) Filed: Dec. 9, 2020

(65) Prior Publication Data

US 2021/0201782 A1 Jul. 1, 2021

(30) Foreign Application Priority Data

Dec. 30, 2019 (KR) ..... 10-2019-0177676

(51) Int. Cl.
*G09G 3/3233* (2016.01)
*G09G 3/3266* (2016.01)
*G09G 3/3275* (2016.01)

(52) U.S. Cl.
CPC ..... *G09G 3/3233* (2013.01); *G09G 3/3266* (2013.01); *G09G 3/3275* (2013.01); *G09G 2300/0819* (2013.01); *G09G 2310/027* (2013.01); *G09G 2310/0286* (2013.01); *G09G 2310/0289* (2013.01); *G09G 2310/08* (2013.01)

(58) Field of Classification Search
None
See application file for complete search history.

(56) References Cited

U.S. PATENT DOCUMENTS

2018/0190197 A1* 7/2018 Chang ..... G09G 3/3233

FOREIGN PATENT DOCUMENTS

KR 10-2018-0025482 A 3/2018
KR 10-2018-0128122 A 12/2018

* cited by examiner

*Primary Examiner* — Christopher J Kohlman
(74) *Attorney, Agent, or Firm* — Seed IP Law Group LLP

(57) ABSTRACT

An electroluminescent display device having a plurality of pixels is disclosed. Each pixel includes a driving transistor having a gate connected to a first node, a source connected to a third node, and a drain connected to a fourth node, the driving transistor generating pixel current corresponding to a data voltage when a high-level source voltage is applied to the third node, a light emitting element connected between the fourth node and an input terminal for a low-level source voltage, an internal compensator controlling voltages of the first to fourth nodes in accordance with operations of a plurality of switching transistors in an initialization period, a data writing period and an emission period, and a refresh transistor configured to apply the high-level source voltage to the second node in accordance with a scan signal in a refresh period preceding an initialization period.

10 Claims, 12 Drawing Sheets

| | |
|---|---|
| N1 | - |
| N2 | Vdata of Previous Frame |
| N3 | ELVDD |
| N4 | ELVSS+Vel |

| | |
|---|---|
| N1 | - |
| N2 | ELVDD |
| N3 | ELVDD |
| N4 | ELVSS+Vel |

| | |
|---|---|
| N1 | Vint |
| N2 | Vint-Vth |
| N3 | Vint-Vth |
| N4 | Vint |

ELECTROLUMINESCENT DISPLAY DEVICE

CROSS-REFERENCE TO RELATED APPLICATIONS

This application claims the benefit of Korean Patent Application No. 10-2019-0177676 filed on Dec. 30, 2019, which is hereby incorporated by reference as if fully set forth herein.

BACKGROUND

Technical Field

The present disclosure relates to an electroluminescent display device.

Description of the Related Art

Luminescent display devices are classified into an inorganic light emitting display device and an electroluminescent display device in accordance with materials of emission layers thereof. Each pixel of such an electroluminescent display device includes a light emitting element configured to emit light in a self-luminous manner, and adjusts luminance by controlling an emission amount of the light emitting element in accordance with a grayscale of image data. The pixel circuit of each pixel may include a driving transistor configured to supply pixel current to the light emitting element, and at least one switching transistor and a capacitor, which are configured to program a gate-source voltage of the driving transistor. The switching transistor, the capacitor, etc., may be designed to have a connection structure capable of compensating for threshold voltage variation of the driving transistor and, as such, may function as a compensation circuit.

BRIEF SUMMARY

Pixel current generated in the driving transistor is determined in accordance with the threshold voltage and the gate-source voltage in the driving transistor. The inventors of the present disclosure has identified that in order to obtain desired luminance in such an electroluminescent display device, first, the node of the pixel circuit to be written with a data voltage should be sufficiently initialized prior to writing of the data voltage. Second, the compensation circuit should be designed in order to prevent, or reduce as great as possible, threshold voltage variation of the driving transistor from influencing pixel current. Third, the gate voltage of the driving transistor should be continuously maintained at a programmed voltage even during light emission of the light emitting element. Accordingly, the inventors of the present disclosure provides an electroluminescent display device that substantially obviates one or more problems due to limitations and disadvantages of the related art.

Embodiments of the present disclosure provide an electroluminescent display device capable of not only sufficiently initializing a node of a pixel circuit to be written with a data voltage prior to writing of the data voltage, but also compensating for threshold voltage variation of a driving transistor.

In addition, embodiments of the present disclosure provide an electroluminescent display device capable of continuously maintaining a gate voltage of a driving transistor at a programmed voltage even during light emission of a light emitting element.

Additional advantages, technical benefits, and features of the present disclosure will be set forth in part in the description which follows and in part will become apparent to those having ordinary skill in the art upon examination of the following or may be learned from practice of the present disclosure. The advantages of the present disclosure may be realized and attained by the structure particularly pointed out in the written description and claims hereof as well as the appended drawings.

To achieve these and other advantages and in accordance with the embodiments of the present disclosure, as embodied and broadly described herein, an electroluminescent display device has a plurality of pixels. Each of the pixels includes a driving transistor having a gate connected to a first node, a source connected to a third node, and a drain connected to a fourth node, the driving transistor generating pixel current corresponding to a data voltage when a high-level source voltage is applied to the third node, a light emitting element connected between the fourth node and an input terminal for a low-level source voltage, an internal compensator including a first capacitor connected between the first node and a second node, and a second capacitor connected between the second node and an input terminal for the high-level source voltage, the internal compensator controlling voltages of the first to fourth nodes in accordance with operations of a plurality of switching transistors in an initialization period, a data writing period and an emission period sequentially set with reference to a first scan signal, a second scan signal opposite to the first scan signal in phase, a third scan signal lagging the first scan signal in phase, and an emission signal, and a refresh transistor configured to apply the high-level source voltage to the second node in accordance with a fourth scan signal leading the first scan signal in phase in a refresh period preceding the initialization period.

It is to be understood that both the foregoing general description and the following detailed description of the present disclosure are explanatory and are intended to provide further explanation of the present disclosure as claimed.

BRIEF DESCRIPTION OF THE SEVERAL VIEWS OF THE DRAWINGS

The accompanying drawings, which are included to provide a further understanding of the present disclosure and are incorporated in and constitute a part of this application, illustrate embodiment(s) of the present disclosure and along with the description serve to explain the principle of the present disclosure. In the drawings.

DETAILED DESCRIPTION

Figure 1:
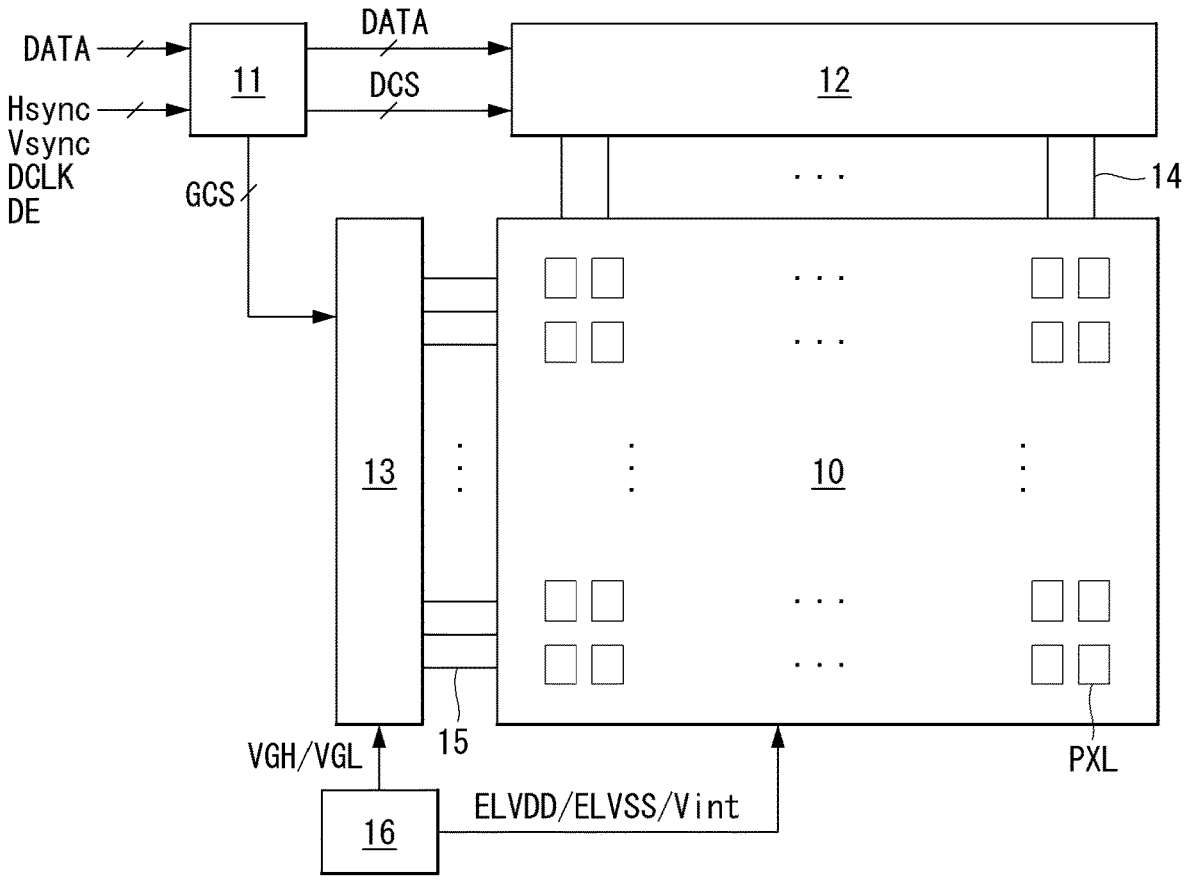
FIG. 1 is a block diagram illustrating an electroluminescent display device according to an embodiment of the present disclosure.

Hereinafter, one or more embodiments of the present disclosure will be described in detail with reference to the accompanying drawings. Throughout the disclosure, the same reference numerals designate substantially the same constituent elements. In describing the present disclosure, a detailed description will be omitted when a specific description of publicly known technologies associated with the contents of the present disclosure is judged to obscure understanding of the contents of the present disclosure.

Each of a pixel circuit and a gate driving circuit in an electroluminescent display device may include at least one of an N-channel transistor (NMOS) or a P-channel transistor (PMOS). Such a transistor is a 3-electrode element including a gate, a source, and a drain. The source is an electrode for supplying carriers to the transistor. Within the transistor, carriers begin to flow from the source. The drain is an electrode through which carriers migrate outwards from the transistor. Carriers flow from the source to the drain in the transistor. In an N-channel transistor, carriers are electrons and, as such, a source voltage is lower than a drain voltage in order to enable electrons to flow from the source to the drain. Current flows from the drain to the source in the N-type transistor. On the other hand, in a P-type transistor, carriers are holes and, as such, a source voltage is higher than a drain voltage in order to enable holes to flow from the source to the drain. Current flows from the source to the drain in the P-type transistor because holes flow from the source to the drain. Here, it should be noted that the source and drain of such a transistor are not fixed. For example, the source and the drain may be interchanged with each other in accordance with voltages applied thereto. As such, the present disclosure is not limited to the source and the drain of a transistor. In the following description, accordingly, the source and the drain of a transistor are referred to as a "first electrode" and a "second electrode."

A scan signal (or a gate signal) applied to each pixel swings between a gate-on voltage and a gate-off voltage. The gate-on voltage is set to a voltage higher than a threshold voltage of a transistor in the pixel, and the gate-off voltage is set to a voltage lower than the threshold voltage of the transistor. The transistor turns on in response to the gate-on voltage, and turns off in response to the gate-off voltage. In an N-channel transistor, the gate-on voltage may be a gate-high voltage VGH, and the gate-off voltage may be a gate-low voltage VGL. In a P-channel transistor, the gate-on voltage may be the gate-low voltage VGL, and the gate-off voltage may be the gate-high voltage VGH.

Each pixel of an electroluminescent display device includes a light emitting element, and a driving element configured to generate pixel current in accordance with a gate-source voltage thereof, thereby driving the light emitting element. The light emitting element includes an anode, a cathode, and an organic compound layer formed between the anode and the cathode. The organic compound layer includes a hole injection layer HIL, a hole transport layer HTL, an emission layer EML, an electron transport layer ETL, and an electron injection layer EIL, without being limited thereto. When pixel current flows in the light emitting element, holes passing through the hole transport layer HTL and electrons passing through the electron transport layer ETL migrate to the emission layer EML and, as such, excitons are produced. As a result, the emission layer EML generates visible light.

The driving element may be embodied as a transistor such as a metal oxide semiconductor field effect transistor (MOSFET). Electrical characteristics (for example, threshold voltages) of driving transistors in pixels should be uniform among the pixels. However, such electrical characteristics may be different among the pixels due to process deviation and deviation in element characteristics. Furthermore, such electrical characteristics may vary with passage of the driving time of the display. In order to compensate for such deviation of electrical characteristics of the driving transistors, an internal compensation method may be applied to the electroluminescent display device. In accordance with the internal compensation method, a compensator is included in the pixel circuit in order to prevent variation in electrical characteristics of the driving transistor from influencing pixel current.

Recently, attempts to embody a part of transistors included in a pixel circuit in an electroluminescent display device as an oxide transistor have increased. In such an oxide transistor, oxide, that is, an oxide produced through combination of indium (In), gallium (Ga), zinc (Zn) and oxygen (O), and referred to as "IGZO," is used in place of polysilicon.

Such an oxide transistor has an advantage in that, although the oxide transistor exhibits lower electron mobility than a low-temperature polysilicon (hereinafter referred to as "LTPS") transistor, the oxide transistor exhibits higher electron mobility than an amorphous silicon transistor by 10 times or more. In addition, the oxide transistor has an advantage in that the manufacturing costs thereof are considerably lower than those of the LTPS transistor, even though the manufacturing costs thereof are higher than those of the amorphous silicon transistor. Furthermore, since the manufacturing process for the oxide transistor is similar to that of the amorphous silicon transistor, existing equipment may be utilized and, as such, the oxide transistor has an advantage of high efficiency. In particular, since off-current of the oxide transistor is low, the oxide transistor has an advantage in that, when the oxide transistor is driven at low speed such that an off-time thereof is relatively long, high driving stability and high reliability may be achieved. Accordingly, such an oxide transistor may be applied to a large-size liquid crystal display device requiring high resolution and low-power driving or an organic light emitting diode (OLED) TV in which obtaining a desired screen size using an LTPS process is impossible.

Figure 2:
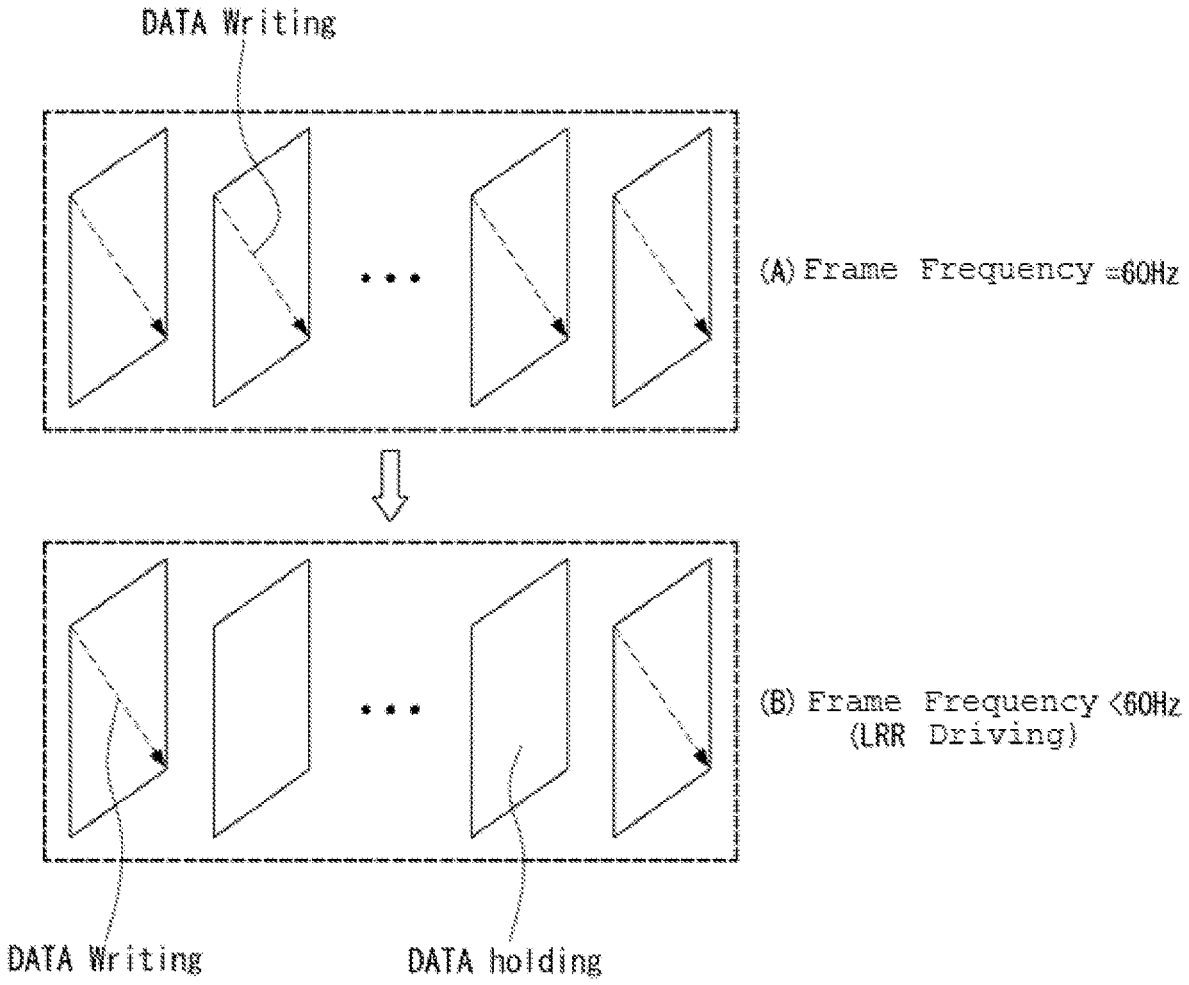
FIG. 2 illustrates a condition in which the electroluminescent display device of FIG. 1 performs low refresh rate (LRR) driving (or low-speed driving)

FIG. 1 is a block diagram illustrating an electroluminescent display device according to an embodiment of the present disclosure. FIG. 2 illustrates a condition in which the electroluminescent display device of FIG. 1 performs low refresh rate (LRR) driving (or low-speed driving).

Referring to FIG. 1, the electroluminescent display device according to the embodiment may include a display panel 10, a timing controller 11, a data driving circuit 12, a gate driving circuit 13, and a power circuit 16. The timing controller 11, the data driving circuit 12, and the power circuit 16 may be completely or partially integrated in a driver integrated circuit.

A plurality of data lines 14 extending in a column direction (or a vertical direction) and a plurality of gate lines 15 extending in a row direction (or a horizontal direction) intersect each other on a screen of the display panel 10 expressing an input image. Pixels PXL are disposed at respective intersection areas in a matrix and, as such, form a pixel array.

Each gate line 15 may include two or more scan lines for supplying two or more scan signals adapted to apply, to corresponding ones of the pixels PXL, a data voltage supplied to each data line 14 and an initialization voltage supplied to an initialization voltage line, respectively, an emission line for supplying an emission signal adapted to enable light emission of the corresponding pixels PXL, etc.

The display panel 10 may further include a first power line for supplying a high-level source voltage ELVDD to the pixels PXL, a second power line for supplying a low-level source voltage ELVSS to the pixels PXL, and the initialization voltage line which supplies an initialization voltage Vint adapted to initialize pixel circuits of the pixel PXL. The first and second power lines and the initialization voltage line are connected to the power circuit 16. The second power line may be formed in the form of a transparent electrode covering a plurality of pixels PXL.

Touch sensors may be disposed on the pixel array of the display panel 10. Touch input may be sensed using separate touch sensors or may be sensed through the pixels PXL. The touch sensors may be embodied as touch sensors disposed on the screen of the display panel 10 in an on-cell type or in an add-on type, or touch sensors built in the pixel array in an in-cell type.

Each of the pixels PXL disposed on the same horizontal line in the pixel array is connected to one of the data lines 14 and one or at least two of the gate lines 15 and, as such, the pixels PXL form a pixel line. Each pixel PXL is electrically connected to the corresponding data line 14 and the initialization voltage line in response to a scan signal and an emission signal applied thereto through the corresponding gate line 15, thereby receiving a data voltage or an initialization voltage Vint. Accordingly, each pixel PXL drives a light emitting element to emit light by pixel current corresponding to the data voltage. The pixels PXL disposed on the same pixel line operate simultaneously in accordance with a scan signal and an emission signal applied through the same gate line 15.

One pixel unit may be implemented by three sub-pixels including a red sub-pixel, a green sub-pixel, and a blue sub-pixel, or four sub-pixels including a red sub-pixel, a green sub-pixel, a blue sub-pixel, and a white sub-pixel, without being limited thereto. Each sub-pixel may be embodied as a pixel circuit including a compensator. In the following description, "pixel" includes the meaning of "sub-pixel."

Each pixel PXL may receive a high-level source voltage ELVDD, an initialization voltage Vint, and a low-level source voltage ELVSS from the power circuit 16, and may include a driving transistor, a light emitting element, and an internal compensator. The internal compensator may be implemented by a plurality of switching transistors and at least one capacitor, as in the case of FIG. 3 which will be described later.

The timing controller 11 supplies image data DATA sent from an external host system (not shown) to the data driving circuit 12. The timing controller 11 receives, from the host system, timing signals such as a vertical synchronization signal Vsync, a horizontal synchronization signal Hsync, a data enable signal DE, and a dot clock DCLK, and, as such, generates control signals adapted to control operation timings of the data driving circuit 12 and the gate driving circuit 13. The control signals include a gate timing control signal GCS adapted to control operation timing of the gate driving circuit 13 and a data timing control signal DCS adapted to control operation timing of the data driving circuit 12.

The data driving circuit 12 samples and latches digital image data DATA input thereto from the timing controller 11, based on the data control signal DCS, thereby changing the digital image data DATA into parallel data. Subsequently, the data driving circuit 12 converts the parallel data into analog data voltages through a digital-analog converter (hereinafter referred to as "DAC") in accordance with a gamma reference voltage, and supplies the data voltages to the pixels PXL via output channels and the data lines 14, respectively. Each data voltage may be a value corresponding to a grayscale to be expressed by a corresponding one of the pixels PXL. The data driving circuit 12 may be implemented by a plurality of driver integrated circuits.

The data driving circuit 12 may include a shift register, a latch, a level shifter, a DAC, and a buffer. The shift register shifts a clock input thereto from the timing controller 11, thereby sequentially outputting clocks for sampling. The latch samples and latches digital image data at timings of sampling clocks sequentially input thereto from the shift register, and simultaneously outputs all sampled pixel data. The level shifter shifts voltages of pixel data input thereto from the latch to be within an input voltage range of the DAC. The DAC converts the pixel data received from the level shifter into data voltages, and then supplies the data voltages to the data lines 14 via the buffer.

The gate driving circuit 13 generates a scan signal and an emission signal based on the gate control signal GCS. In this case, the gate driving circuit 13 generates the scan signal and the emission signal in a row sequential manner in an active period, and then sequentially applies the scan signal and the emission signal to the gate lines 15 connected to respective pixel lines. A particular scan signal of each gate line 15 is synchronized with timing of data voltage supply to the data lines 14. The scan signal and the emission signal swing between a gate-on voltage and a gate-off voltage.

The gate driving circuit 13 may be implemented by a plurality of gate driver integrated circuits each including a shift register, a level shifter for converting an output signal from the shift register into a signal having a swing width suitable for TFT driving of pixels, an output buffer, etc. Alternatively, the gate driving circuit 13 may be directly formed at a lower substrate of the display panel 10 in a gate-driver IC in panel (GIP) manner. When the gate driving circuit 13 is of a GIP type, the level shifter may be mounted on a printed circuit board (PCB), and the shift register may be formed on the lower substrate of the display panel 10.

The power circuit 16 adjusts a DC input voltage supplied from the host system using a DC-DC converter, thereby generating a gate-on voltage VGH, a gate-off voltage VGL, etc., required for operation of the data driving circuit 12 and the gate driving circuit 13. The power circuit 16 also generates a high-level source voltage ELVDD, an initialization voltage Vint, and a low-level source voltage ELVSS required for driving of the pixel array.

The host system may be an application processor (AP) in a mobile appliance, a wearable appliance, a virtual/augmented reality appliance, or the like. Otherwise, the host system may be a main board in a television system, a set-top box, a navigation system, a personal computer, a home theater system, or the like. Of course, embodiments of the present disclosure are not limited to the above-described conditions.

FIG. 2 illustrates a condition in which the electroluminescent display device of FIG. 1 performs low refresh rate (LRR) driving (or low-speed driving).

Referring to FIG. 2, the electroluminescent display device according to one embodiment may adopt LRR driving in order to reduce power consumption. LRR driving illustrated in (B) in FIG. 2 reduces the number of image frames in which data voltages are written, as compared to 60 Hz driving illustrated in (A) in FIG. 2. In 60 Hz driving, 60 image frames are reproduced per second. Data voltage writing operation is carried out for all of the 60 image frames. On the other hand, in LRR driving, data voltage writing operation is carried out only for a part of the 60 image frames. In LRR driving, in each of the remaining image frames, data voltages written in a previous image frame are maintained (held). In other words, output operations of the data driving circuit 12 and the gate driving circuit 13 are stopped for the remaining image frames and, as such, there is an effect of reducing power consumption. In some embodiments, when a first image frame and a second image frame, in which the data voltage is written in the pixels, are present, a plurality of third image frames, in which the data voltage written in the first image frame is maintained, may be disposed between the first image frame and the second image frame. LRR driving may be applied to a still image or a moving image exhibiting image variation, and a data voltage update period therein may be longer than that of 60 Hz driving. In a pixel circuit, accordingly, the time for which the gate-source voltage of a driving transistor is maintained is longer in LRR driving than in 60 Hz driving. In LRR driving, it is beneficial to maintain the gate-source voltage of the driving transistor for a selected time (or in some cases, for a predetermined time). To this end, the switching transistors directly/indirectly connected to the gate of the driving transistor may be embodied as oxide transistors exhibiting excellent off characteristics, respectively. Meanwhile, 60 Hz driving and LRR driving may be selectively applied to the embodiment in accordance with characteristics of an input image.

Figure 3:
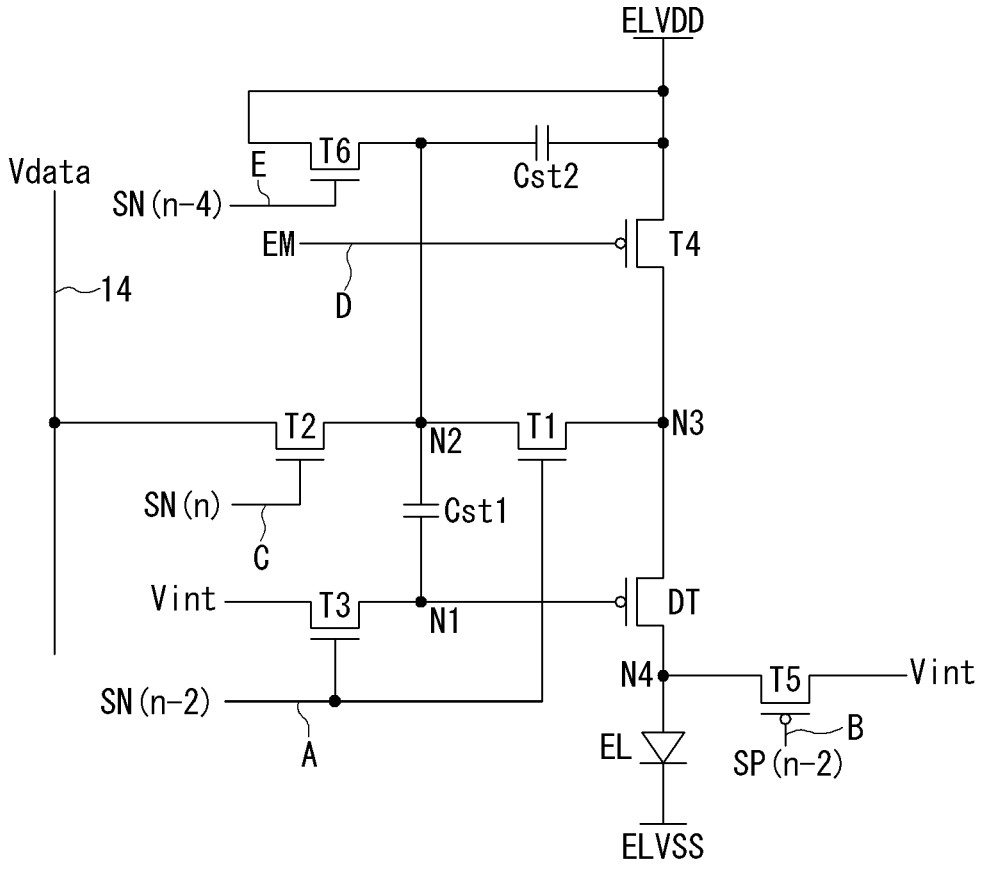
FIG. 3 is an equivalent circuit diagram of one pixel included in the electroluminescent display device of FIG. 1.

FIG. 3 is an equivalent circuit diagram of one pixel included in the electroluminescent display device of FIG. 1. In the following description, a first electrode of a transistor may be one of a source and a drain, and a second electrode of the transistor may be the other of the source and the drain.

Referring to FIG. 3, a pixel circuit of the pixel is connected to a data line 14, a first scan line A, a second scan line B, a third scan line C, a fourth scan line E, and an emission line D. The pixel circuit receives a data voltage Vdata from the data line 14, receives a first scan signal SN(n−2) from the first scan line A, receives a second scan signal SP(n−2) from the second scan line B, receives a third scan signal SN(n) from the third scan line C, receives a fourth scan signal SN(n−4) from the fourth scan line E, and receives an emission signal EM from the emission line D. The first scan signal SN(n−2) and the second scan signal SP(n−2) have opposite phases. The third scan signal SN(n) has a phase lagging the phase of the first scan signal SN(n−2). The fourth scan signal SN(n−4) has a phase leading the phase of the first scan signal SN(n−2).

Referring to FIG. 3, the pixel circuit may include a driving transistor DT, a light emitting element EL, an internal compensator, and a refresh transistor T6.

The driving transistor DT is adapted to generate pixel current enabling the light emitting element EL to emit light in conformity with a data voltage Vdata. The driving transistor DT is connected, at the first electrode thereof, to a third node N3 while being connected, at the second electrode thereof, to a fourth node N4. The gate of the driving transistor DT is connected to a first node N1.

The light emitting element EL includes an anode connected to the fourth node N4, a cathode connected to an input terminal for a low-level source voltage ELVSS, and an emission layer disposed between the anode and the cathode. The light emitting element EL may be embodied as an organic light emitting diode including an organic emission layer or an inorganic light emitting diode including an inorganic emission layer.

The internal compensator is adapted to compensate for a threshold voltage of the driving transistor DT. The internal compensator may be implemented by five switching transistors T1 to T5, and two capacitors Cst1 and Cst2. In this case, at least a part of the switching transistors T1 to T5 may be implemented by an oxide transistor.

The internal compensator includes a first capacitor Cst1 connected between the first node N1 and a second node N2, and a second capacitor Cst2 connected between the second node N2 and an input terminal for a high-level source voltage ELVDD. The internal compensator functions to reflect the threshold voltage of the driving transistor DT in the gate-source voltage of the driving transistor DT in an emission period P6 by controlling voltages of the first to fourth nodes N1, N2, N3 and N4 in accordance with operation of a plurality of transistors in an initialization period P2, a data writing period P4, and an emission period P6 sequentially set with reference to the first scan signal SN(n−2), the second scan signal SP(n−2) opposite to the first scan signal SN(n−2) in phase, the third scan signal SN(n) lagging the first scan signal SN(n−2) in phase, and the emission signal EM. When the threshold voltage of the driving transistor DT is reflected in the gate-source voltage of the driving transistor DT in the emission period P6, pixel current flowing through the driving transistor DT is not substantially influenced by a variation in the threshold voltage of the driving transistor DT. As such, threshold voltage variation of the driving transistor DT is compensated for within the pixel.

The first switching transistor T1 is adapted to apply the threshold voltage of the driving transistor DT to the second node N2. One of the first and second electrodes in the first switching transistor T1 is connected to the second node N2, and the other of the first and second electrodes is connected to the third node N3. The gate of the first switching transistor T1 is connected to the first scan line A to receive the first scan signal SN(n−2).

The second switching transistor T2 is adapted to supply a data voltage Vdata of the data line 14 to the second node N2. One of the first and second electrodes in the second switching transistor T2 is connected to the data line 14, and the other of the first and second electrodes is connected to the second node N2. The gate of the second switching transistor T2 is connected to the third scan line C to receive the third scan signal SN(n).

The third switching transistor T3 is adapted to supply an initialization voltage Vint to the gate electrode of the driving transistor DT, that is, the first node N1. One of the first and second electrodes in the third switching transistor T3 is connected to an input terminal for the initialization voltage Vint, and the other of the first and second electrodes is connected to the first node N1. The gate of the third switching transistor T3 is connected to the first scan line A to receive the first scan signal SN(n−2).

The fourth switching transistor T4 is adapted to control light emission of an OLED, that is, the light emitting element EL. One of the first and second electrodes in the fourth switching transistor T4 is connected to an input terminal for a high-level source voltage ELVDD, and the other of the first and second electrodes is connected to the third node N3. The gate of the fourth switching transistor T4 is connected to the emission line D to receive an emission signal EM.

The fifth switching transistor T5 is adapted to supply the initialization voltage Vint to the anode of the light emitting element EL. One of the first and second electrodes in the fifth switching transistor T5 is connected to the anode of the light emitting element EL, and the other of the first and second electrodes is connected to the input terminal for the initialization voltage Vint. The gate of the fifth switching transistor T5 is connected to the second scan line B to receive the second scan signal SP(n−2).

Figure 6:
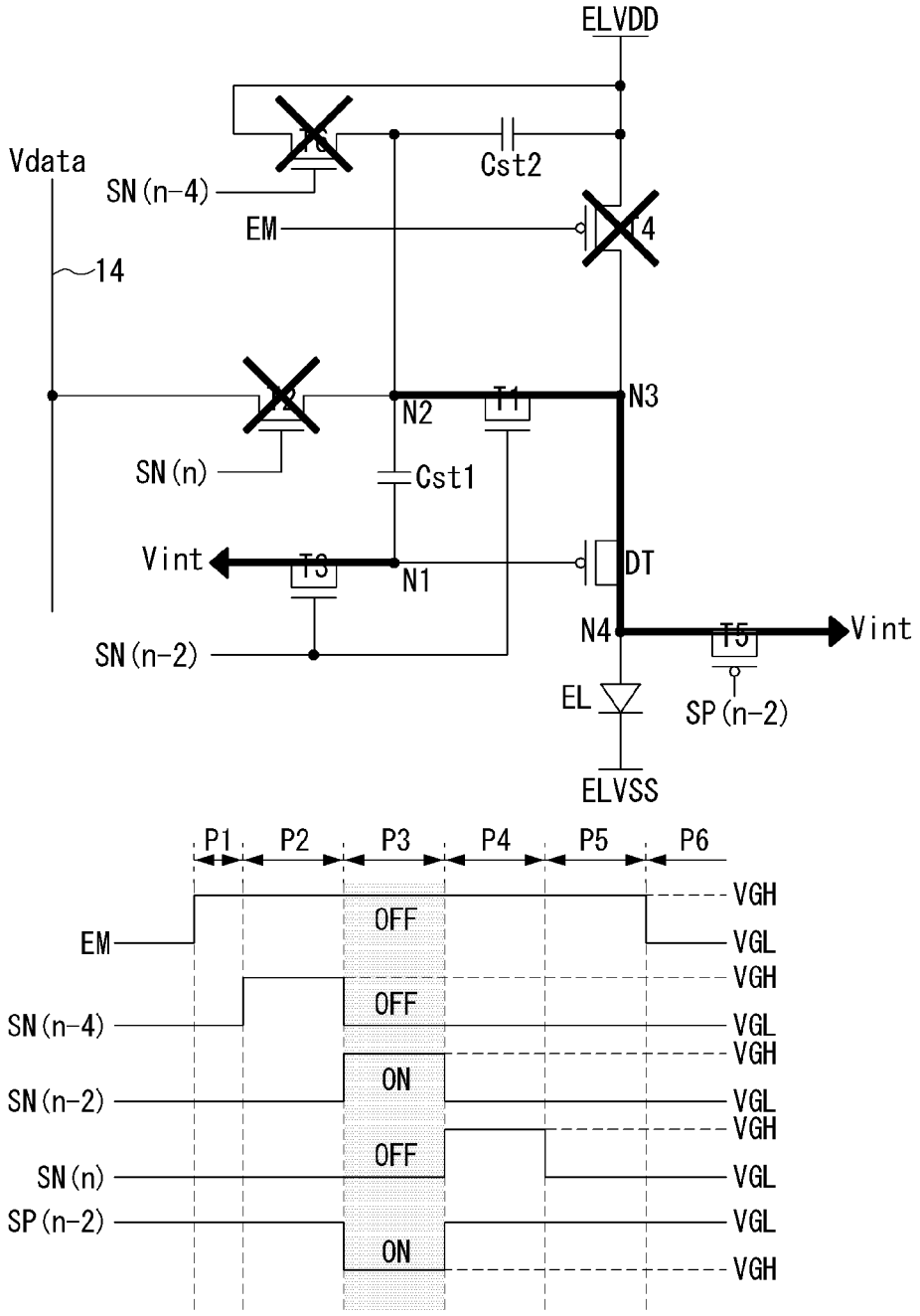
FIG. 6 show diagrams explaining operation of each pixel in a period P3.

The first storage capacitor Cst1 is connected between the first node N1 and the second node N2 to store the threshold voltage of the driving transistor DT in the initialization period (see P3 in FIG. 6).

Figure 7:
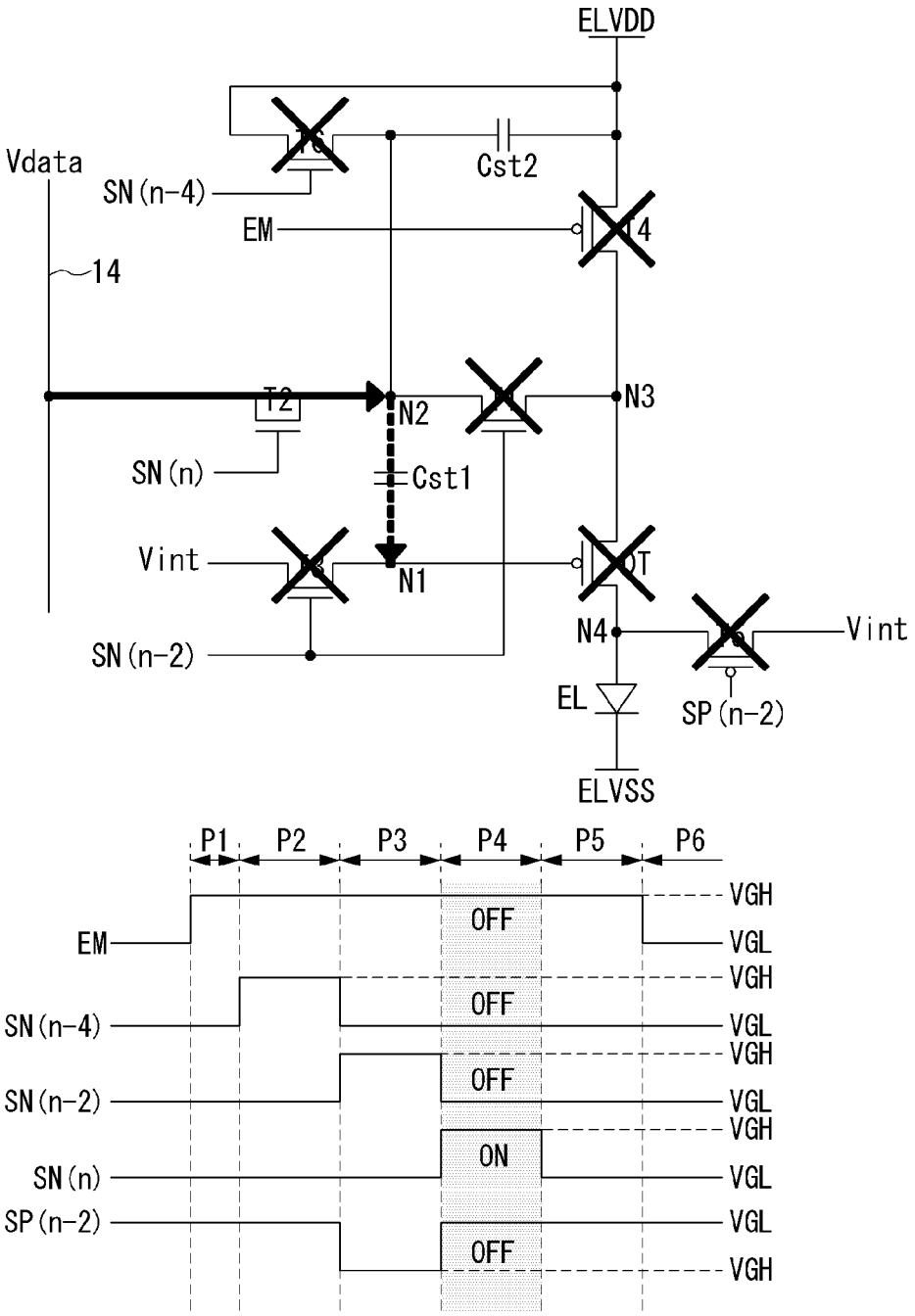
FIG. 7 show diagrams explaining operation of each pixel in a period P4.

The second storage capacitor Cst2 functions to store the data voltage Vdata in the data writing period (see P4 in FIG. 7). One of the first and second electrodes in the second storage capacitor Cst2 is connected to the second node N2, and the other of the first and second electrodes is connected to the input terminal for the high-level source voltage ELVDD.

The pixel current flowing through the driving transistor DT is determined by the gate-source voltage of the driving transistor DT, that is, the voltages of the first and third nodes N1 and N3, in an emission period. In the emission period, the voltage of the third node N3 is fixed to the high-level source voltage ELVDD, but the voltage of the first node N1 is influenced by off characteristics of the third switching transistor T3. This is because the first node N1 is in a floating state due to an OFF state of the third switching transistor T3 in the emission period. Accordingly, the third switching transistor T3 may be embodied as an N-type oxide transistor having excellent off characteristics (that is, low off-current). In addition, the first and second switching transistors T1 and T2, which are maintained in an OFF state in the emission period, may be embodied as an N-type oxide transistor having excellent off characteristics (that is, low off-current) because the first and second switching transistors T1 and T2 may have an influence on the voltage of the first node N1 due to coupling actions thereof through the first storage capacitor Cst1. Meanwhile, the driving transistor DT may be embodied as a P-type low-temperature polysilicon (LTPS) transistor having excellent electron mobility because the driving transistor DT generates pixel current. Similarly, the fourth and fifth switching transistors T4 and T5 may be embodied as a P-type LTPS transistor. In a P-channel transistor, the gate-on voltage turning on the transistor is a gate-low voltage VGL, and the gate-off voltage turning off the transistor is a gate-high voltage VGH. In an N-channel transistor, the gate-on voltage turning on the transistor is a gate-high voltage VGH, and the gate-off voltage turning off the transistor is a gate-low voltage VGL.

In a refresh period (see P2 in FIG. 5) preceding the initialization period, the refresh transistor T6 applies the high-level source voltage ELVDD to the second node N2, thereby refreshing the data voltage of a previous frame charged in the second node N2 to the high-level source voltage ELVDD. As the area and resolution of the display panel increase, the time assigned to the initialization period and the data writing period is reduced. In this case, in a pixel in which the data voltage of the previous frame is relatively low, the potential of the second node N2 may be lowered from the data voltage to a predetermined voltage Vint−Vth within the short initialization period. However, such operation may not be achieved in a pixel in which the data voltage of the previous frame is relatively high. Consequently, in pixels, the voltage of each second node N2 just after initialization may be varied in accordance with the data voltage level of the previous frame. When there are initialization deviations among the pixels, threshold voltage compensation degrees of the pixels may be different and, as such, it may be difficult to achieve an enhancement in picture quality. The refresh transistor T6 is adapted to solve such a problem. In all pixels, the refresh transistors T6 function to unify the potentials of the second nodes N2 into the high-level source voltage ELVDD.

The gate of the refresh transistor T6 is connected to the fourth scan line E to receive the fourth scan signal SN(n−4). One of the first and second electrodes in the refresh transistor T6 is connected to the input terminal for the high-level source voltage ELVDD, and the other of the first and second electrodes is connected to the second node N2. The refresh transistor T6 is maintained in an ON state only in the refresh period P2 while being maintained in an OFF state in the remaining periods. Since the refresh transistor T6 is maintained in an OFF state in the initialization period P3, the refresh transistor also may be embodied as an N-type oxide transistor, for stable potential maintenance of the second node N2 during the initialization period P3.

Figure 4:
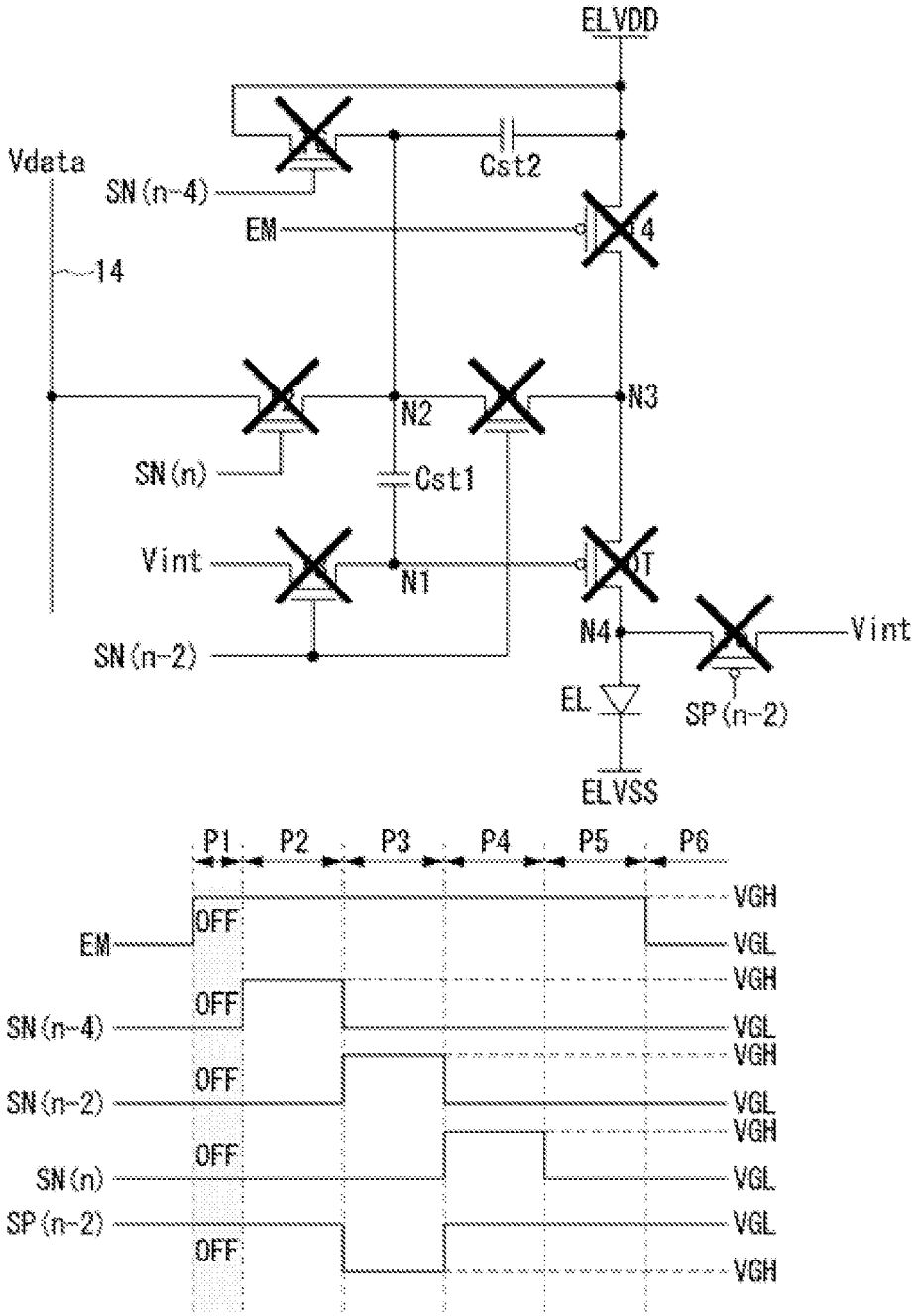
FIG. 4 show diagrams explaining operation of each pixel in a period P1.
Figure 5:
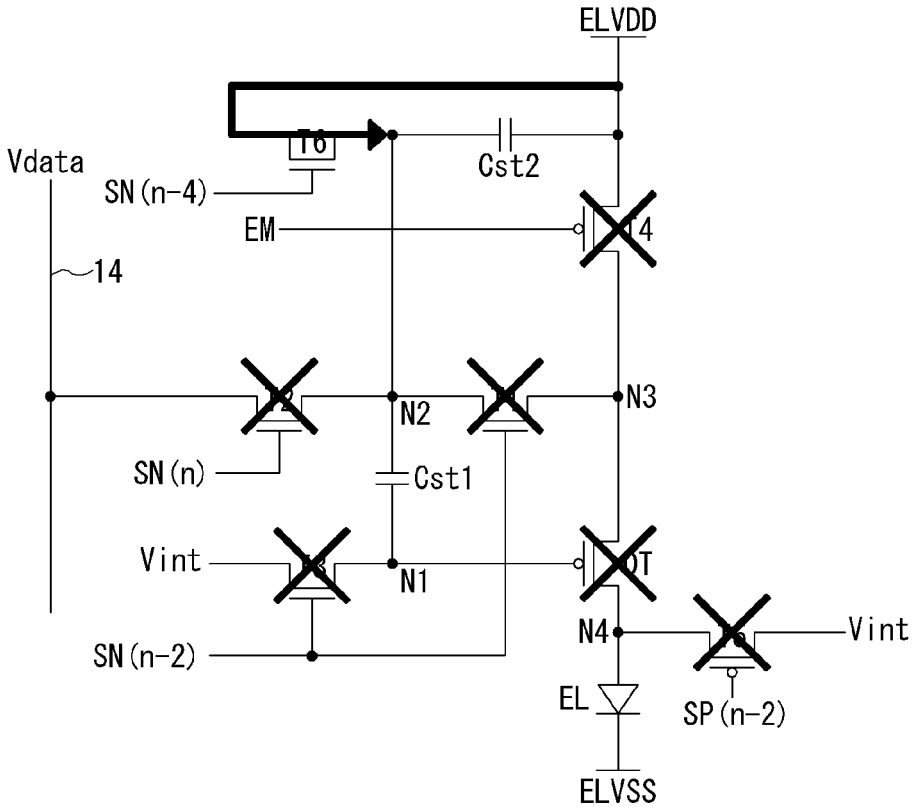
FIG. 5 show diagrams explaining operation of each pixel in a period P2.
Figure 5:
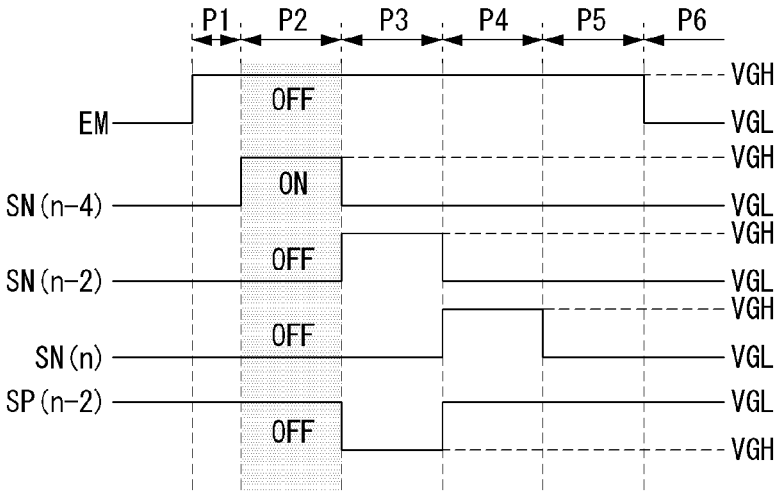
Figure 8:
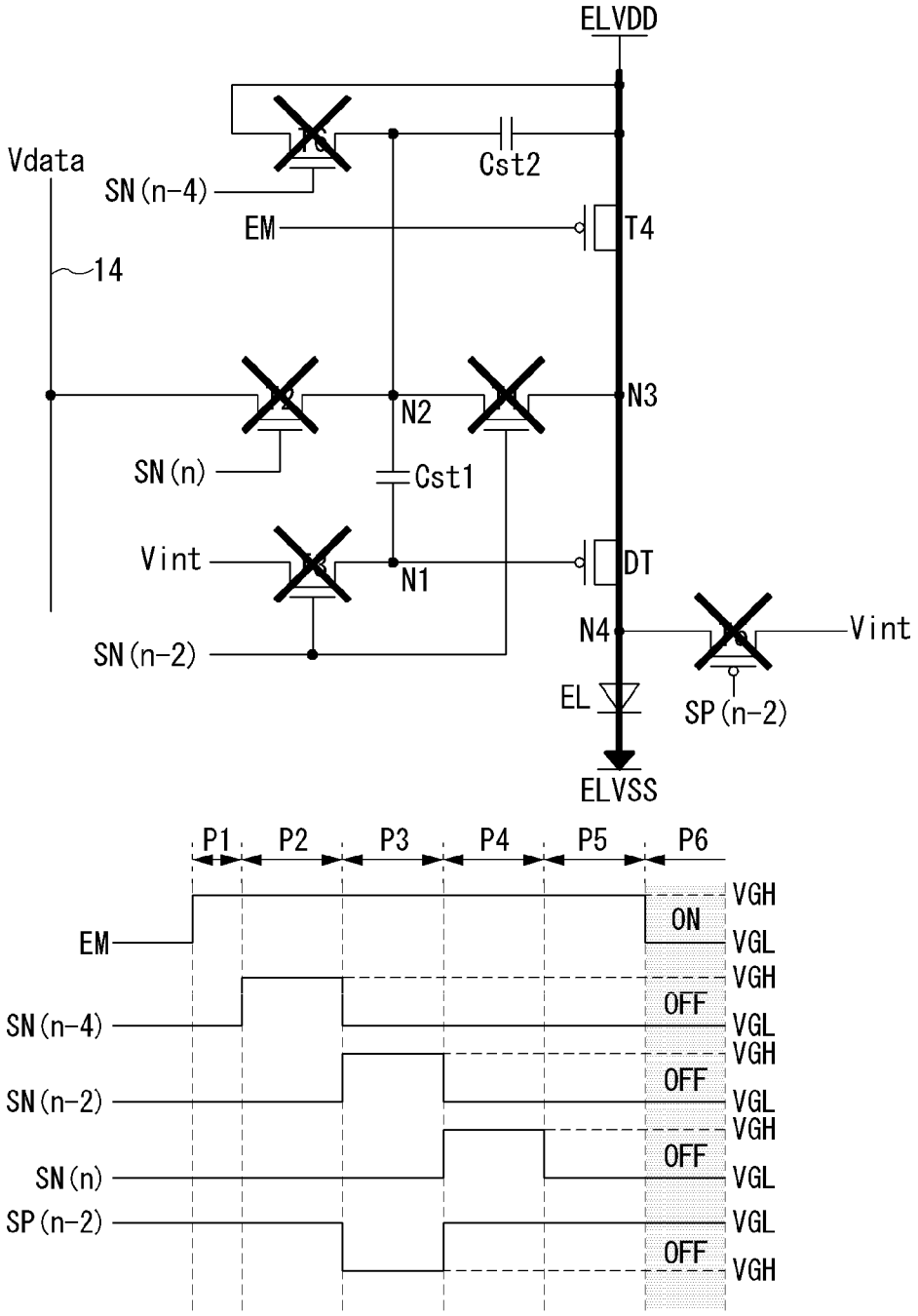
FIG. 8 show diagrams explaining operation of each pixel in a period P6.
Figure 9:
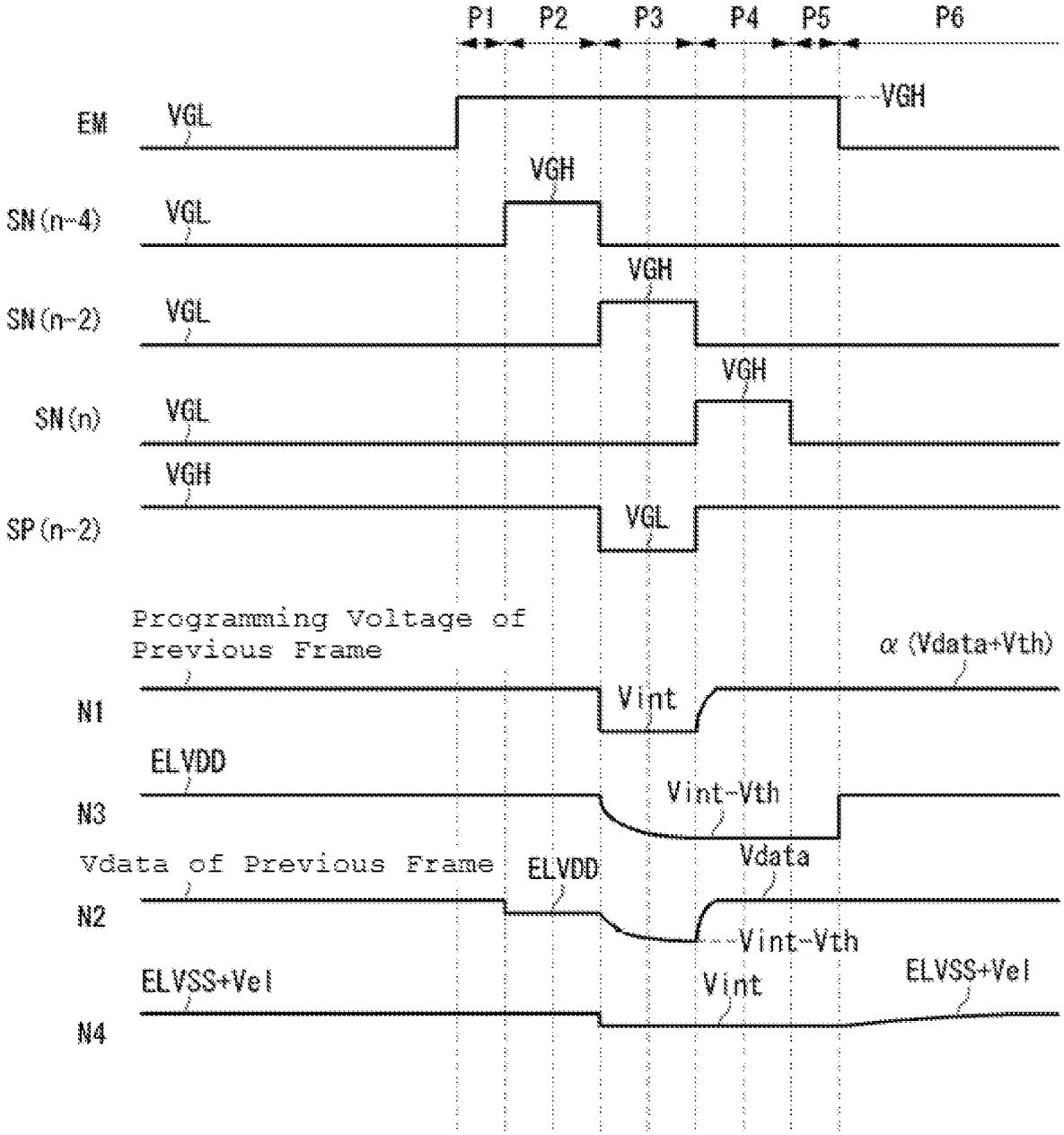
FIG. 9 is a diagram showing voltage variations of the first to fourth nodes in periods P1 to P6.

FIG. 4 show diagrams explaining operation of each pixel in a period P1. FIG. 5 show diagrams explaining operation of each pixel in a period P2. FIG. 6 show diagrams explaining operation of each pixel in a period P3. FIG. 7 show diagrams explaining operation of each pixel in a period P4. FIG. 8 show diagrams explaining operation of each pixel in a period P6. FIG. 9 is a diagram showing voltage variations of the first to fourth nodes in periods P1 to P6.

In FIGS. 4 to 9, P1 represents a first holding period, P2 represents a refresh period, P3 represents an initialization period, P4 represents a data writing period, P5 represents a second holding period, and P6 represents an emission period. The third scan signal SN(n) is a control signal for supply of data voltages Vdata to respective pixels of the current pixel line (the n-th horizontal line). The first scan signal SN(n−2) is a control signal for supply of data voltages Vdata to respective pixels of the pixel line preceding the current pixel line by two pixel lines, that is, respective pixels of the n−2-th horizontal line. The first scan signal SN(n−2) is also a control signal for supply of the initialization voltage Vint to the pixels of the current pixel line (the n-th horizontal line). The second scan signal SP(n−2) is a control signal for initialization of the anode of the light emitting element EL prior to application of data voltages to the current pixel line. The second scan signal SP(n−2) is supplied at the same timing as the first scan signal SN(n−2) while having an opposite phase to the first scan signal SN(n−2). The fourth scan signal SN(n−4) is a control signal for supply of data voltages Vdata to respective pixels of the pixel line preceding the current pixel line by four pixel lines, that is, respective pixels of the n−4-th horizontal line. The fourth scan signal SN(n−4) is also a control signal for supply of the high-level source voltage ELVDD to the pixels of the current pixel line (the n-th horizontal line), for refresh.

As shown in FIGS. 4 and 9, in the first period P1, all of the first to fourth scan signals SN(n−2), SP(n−2), SN(n) and SN(n−4), and the emission signal EM have a gate-off voltage. All of the first to fifth switching transistors T1 to T5, the refresh transistor T6 and the driving transistor DT turn off and, as such, each of the first, second, third and fourth nodes N1, N2, N3 and N4 is maintained in a previous voltage state thereof, or the voltage state thereof cannot be determined.

As shown in FIGS. 5 and 9, in the second period P2, the fourth scan signal SN(n−4) has a gate-on voltage, and all of the first to third scan signals SN(n−2), SP(n−2) and SN(n) and the emission signal EM have a gate-off voltage. The refresh transistor T6 turns on by the fourth scan signal SN(n−4) having the gate-on voltage and, as such, the high-level source voltage ELVDD is supplied to the second node N2. The voltage of the second node N2 is refreshed from the data voltage Vdata of the previous frame to the high-level source voltage ELVDD.

As shown in FIGS. 6 and 9, in the third period P3, the first and second scan signals SN(n−2) and SP(n−2) have a gate-on voltage (ON level), and the third and fourth scan signals SN(n) and SN(n−4), and the emission signal EM have a gate-off voltage. The first, third and fifth switching transistors T1, T3 and T5 turn on by the first and second scan signals SN(n−2) and SP(n−2) having the gate-on voltage. Accordingly, the initialization voltage Vint is supplied to the first node N1 through the third switching transistor T3, and current flows through the second to fourth nodes N2, N3 and N4 via the first transistor T1, the driving transistor DT, and the fifth transistor T5. That is, current flows in a direction of the first switching transistor, to the driving transistor DT, and to the fifth switching transistor T5 (i.e., current flow direction: the first switching transistor T1→the driving transistor DT→the fifth switching transistor T5) or in an opposite direction (i.e., opposite current flow direction: the fifth switching transistor T5→the driving transistor DT→the first switching transistor T1). Accordingly, each voltage of the second node N2 and the third node N3 is lowered from the initialization voltage Vint by the threshold voltage Vth of the driving transistor DT and, as such, each potential of the second node N2 and the third node N3 rises (or drops) until the driving transistor DT turns off. Accordingly, when the second period P2 ends, the voltage of the first node N1 becomes the initialization voltage Vint, and each voltage of the second and third nodes N2 and N3 becomes a voltage Vint−Vth lower than the initialization voltage Vint by the threshold voltage Vth of the driving transistor DT. In this case, the threshold voltage Vth of the driving transistor DT is stored in the first storage capacitor Cst1.

In the third period P3, the potential of the first node N1 immediately becomes the initialization voltage Vint, and the potential difference between the high-level source voltage ELVDD and the initialization voltage Vint of the first node N1 is divided by the first and second storage capacitors Cst1 and Cst2. The divided potential is immediately formed at the second node N2. Subsequently, the potential of the second node N2 becomes a voltage Vint−Vth through reflection of the initialization voltage Vint and the threshold voltage Vth by current according to the initialization voltage Vint. Accordingly, the time taken for the potential of the second node N2 to be fixed is not long.

As shown in FIGS. 7 and 9, in the fourth period P4, the third scan signal SN(n) is a gate-on voltage, and each of the remaining scan signals SN(n−4), SN(n−2) and SP(n−2), and the emission signal EM is a gate-off voltage. The second switching transistor T2 turns on by the third scan signal SN(n) which is a gate-on voltage and, as such, the data voltage Vdata is supplied from the data line 14 to the second node N2.

In the fourth period P4, the voltage of the first node N1 has a value a (Vdata+Vth) obtained by adding the threshold voltage Vth of the driving transistor DT to the data voltage Vdata because the second node N2 has the data voltage Vdata under the condition in which the potential difference between opposite electrodes of the first storage capacitor Cst1 is still maintained. Here, "α" represents a value obtained by dividing the capacitance of the first storage capacitor Cst1 by a sum of the capacitance of the first storage capacitor Cst1 and a total of parasitic capacitances connected to the first node N1. Since the capacitance of the first storage capacitor Cst1 is considerably greater than the total of the parasitic capacitances connected to the first node N1, "α" approximates to 1 and, as such, may be neglected.

In the fourth period P4, the charge amount accumulated in the first storage capacitor Cst1 does not vary, and only the potentials at the opposite electrodes of the first storage capacitor Cst1 vary at the same rate. Accordingly, in the fourth period P4, the time taken for the potential of the first node N1 to be set to the data voltage Vdata (exactly, a data voltage in which the threshold voltage is reflected) is reduced.

In the fourth period P4, the voltage of the first node N1 is "α (Vdata+Vth)", the voltage of the second node N2 is the data voltage Vdata, the voltage of the third node N3 is "Vint−Vth", and the voltage of the fourth node N4 is the initialization voltage Vint.

As shown in FIG. 9, in the fifth period P5, the node voltages in the fourth period P4 are maintained.

As shown in FIGS. 8 and 9, in the sixth period P6, each of the first to third scan signals SN(n−2), SP(n−2) and SN(n) is a gate-off voltage, and the emission signal EM is a gate-on voltage. All of the first to third switching transistors T1 to T3, the fifth switching transistor T5, and the sixth switching transistor T6 turn off, but the fourth switching transistor T4 turns on by the emission signal EM. In addition, the high-level source voltage ELVDD is input to the third node N3, and the voltage of the first node N1 is maintained at a voltage value a (Vdata+Vth) lower than the high-level source voltage ELVDD. Accordingly, the driving transistor DT turns on, thereby resulting in flow of pixel current. Such pixel current is applied to the light emitting element EL which, in turn, emits light.

Pixel current $I_{EL}$ is proportional to a square of a value obtained by deducting the threshold voltage Vth of the driving transistor DT from the gate-source voltage Vgs of the driving transistor DT, and may be expressed by the following Expression 1:

$$I_{EL} \propto (Vgs-Vth)^2=(a(Vdata+Vth)-ELVDD-Vth)^2=(aVdata-ELVDD)^2 \quad \text{Expression 1}$$

As shown in Expression 1, components of the threshold voltage Vth of the driving transistor DT are erased in the relational expression of the pixel current $I_{EL}$ and, as such, the pixel current $I_{EL}$ may be determined irrespective of a variation in the threshold voltage of the driving transistor DT. The pixel current $I_{EL}$ is a value corresponding to a difference between the data voltage Vdata and the high-level source voltage ELVDD, and may enable the light emitting element EL to emit light. The potential of the anode of the light emitting element EL rises to a turn-on voltage ELVSS+Vel by the pixel current $I_{EL}$. "Vel" means a threshold voltage or an operating point voltage of the light emitting element EL. From the potential rising time, the light emitting element EL may begin to emit light.

Figure 10:
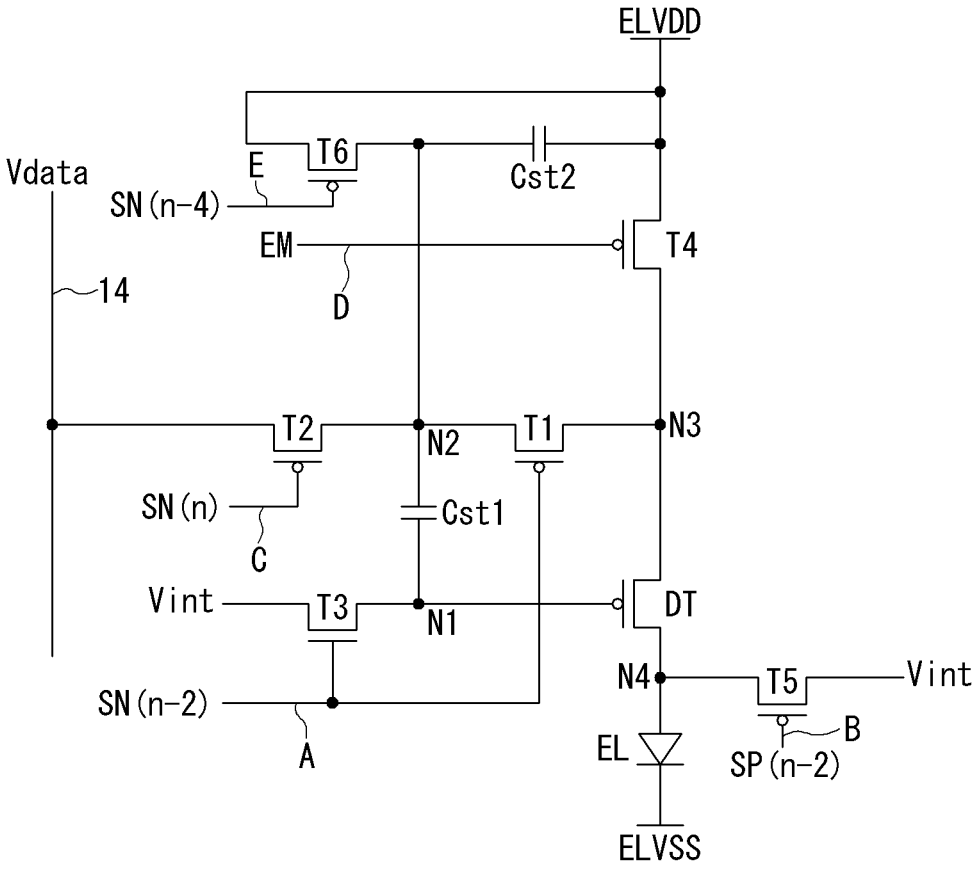
FIGS. 10 to 12 illustrate other embodiments of pixels included in the electroluminescent display device of FIG. 1, respectively.
Figure 11:
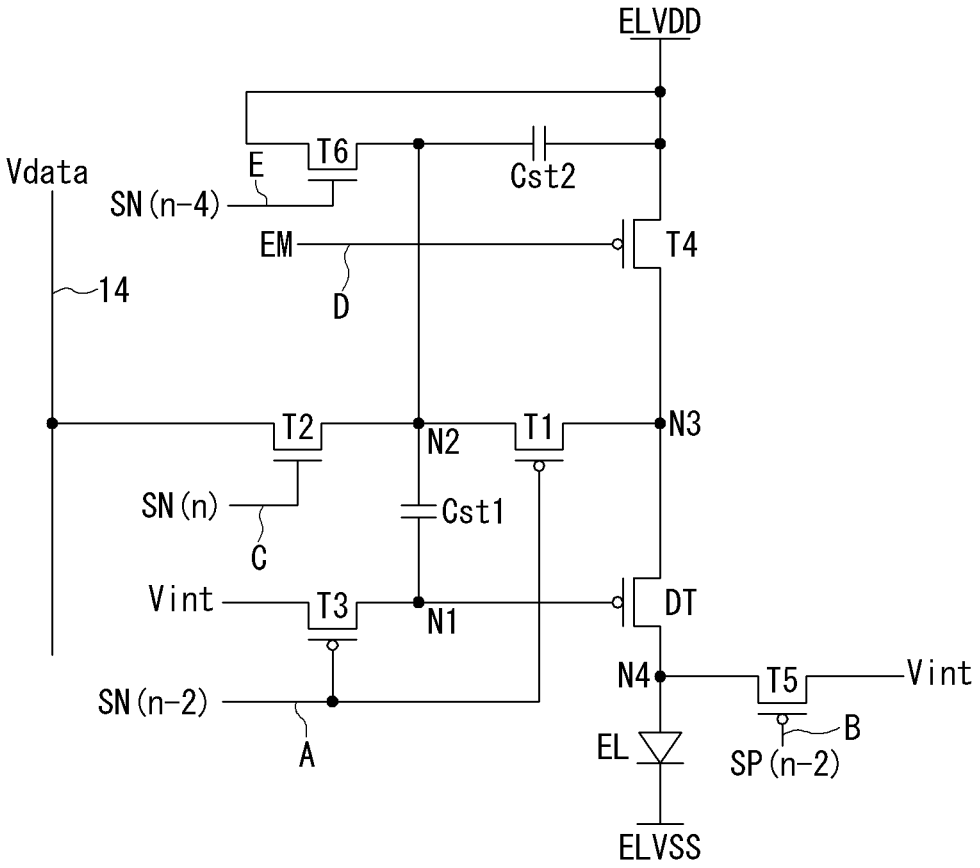
Figure 12:
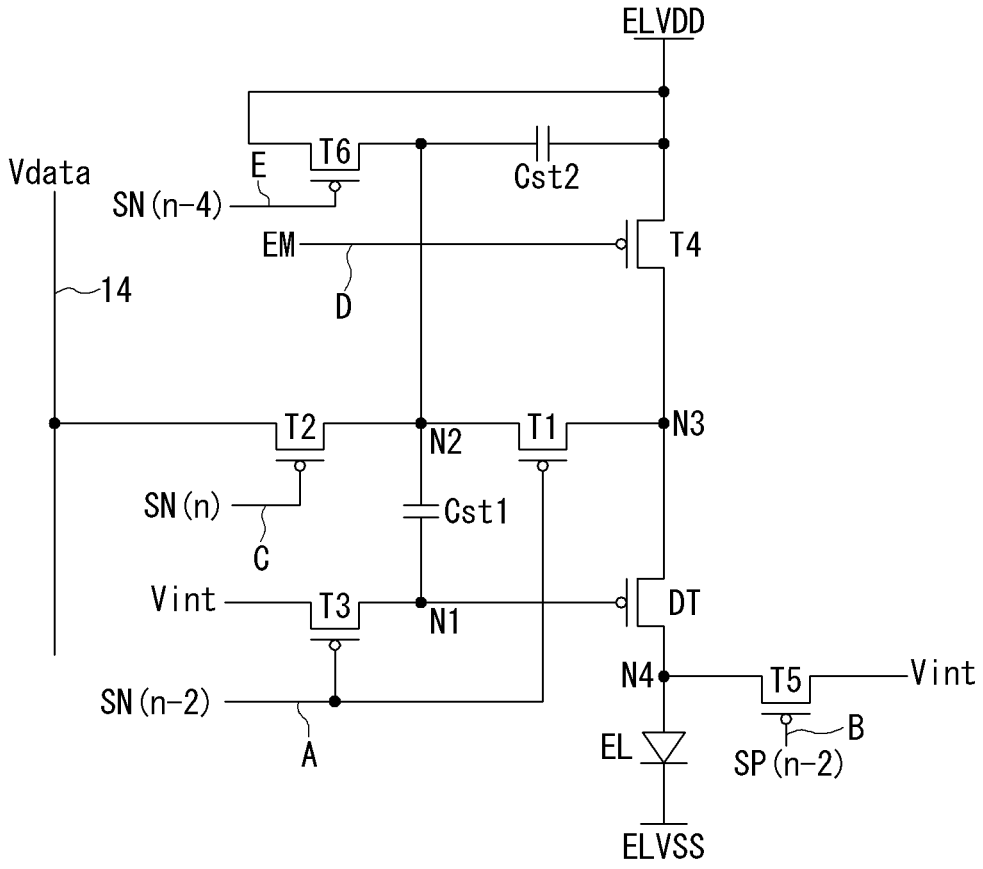

FIGS. 10 to 12 illustrate other embodiments of pixels included in the electroluminescent display device of FIG. 1, respectively.

Pixel circuits of FIGS. 10 to 12 are identical to the pixel circuit of FIG. 3 in terms of the connection structure of elements. However, the pixel circuits of FIGS. 10 to 12 differ from the pixel circuit of FIG. 3 in terms of channel types of transistors while being distinguished from one another.

In the case of FIG. 3, each of the first switching transistor T1, the second switching transistor T2, the third switching transistor T3, and the refresh transistor T6 includes an oxide semiconductor layer and, as such, is embodied as an N-channel oxide transistor having excellent off characteristics, thereby suppressing the potential of the first node N1 and the potential of the second node N2 from varying due to off-current. On the other hand, each of the fourth switching transistor T4, the fifth switching transistor T5, and the driving transistor DT includes a low-temperature polysilicon (LTPS) semiconductor layer and, as such, is embodied as an LTPS transistor having excellent electron mobility, thereby achieving an enhancement in response characteristics through an enhancement in current transport ability.

Referring to FIG. 10, the third switching transistor T3 includes an oxide semiconductor layer and, as such, is embodied as an N-channel oxide transistor having excellent off characteristics, thereby suppressing the potential of the first node N1 from varying due to off-current. On the other hand, each of the first switching transistor T1, the second switching transistor T2, the fourth switching transistor T4, the fifth switching transistor T5, the refresh transistor T6, and the driving transistor DT includes an LTPS semiconductor layer and, as such, is embodied as a P-channel LTPS transistor having excellent electron mobility, thereby achieving an enhancement in response characteristics through an enhancement in current transport ability.

Referring to FIG. 11, each of the second switching transistor T2 and the refresh transistor T6 includes an oxide semiconductor layer and, as such, is embodied as an N-channel oxide transistor having excellent off characteristics, thereby suppressing the potential of the first node N1 and the potential of the second node N2 from varying due to off-current. On the other hand, each of the first switching transistor T1, the third switching transistor T3, the fourth switching transistor T4, the fifth switching transistor T5, and the driving transistor DT includes an LTPS semiconductor layer and, as such, is embodied as a P-channel LTPS transistor having excellent electron mobility, thereby achieving an enhancement in response characteristics through an enhancement in current transport ability.

Referring to FIG. 12, all transistors included in the pixel circuit include LTPS semiconductor layers and, as such, are embodied as P-channel LTPS transistors having excellent electron mobility, respectively, thereby achieving an enhancement in response characteristics through an enhancement in current transport ability. Furthermore, the transistors may provide process convenience.

The electroluminescent display device according to each of the embodiments of the present disclosure further includes a refresh transistor in order to sufficiently initialize a node of each pixel circuit to be written with a data voltage prior to writing of the data voltage. Accordingly, the nodes of all pixel circuits may be refreshed by a high-level source voltage prior to initialization operation thereof and, as such, it may be possible to prevent generation of initialization deviations among the pixel circuits, and to increase or maximize a threshold voltage compensation effect.

In each of the embodiments of the present disclosure, an internal compensator is included in each pixel circuit in order to prevent threshold voltage variation of a driving transistor from being reflected in pixel current. Accordingly, an enhancement in picture quality may be achieved.

In each of the embodiments of the present disclosure, switching transistors directly/indirectly connected to the gate of the driving transistor are embodied as oxide transistors having excellent off characteristics, respectively. Accordingly, the gate voltage of the driving transistor may be continuously maintained at a programmed voltage even during light emission of a light emitting element and, as such, an enhancement in picture quality may be achieved.

It will be apparent to those skilled in the art that various modifications and variations can be made in the present disclosure without departing from the spirit or scope of the disclosure.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. An electroluminescent display device, comprising:

a plurality of pixels, wherein each of the pixels include:

a driving transistor having a gate connected to a first node, a source connected to a third node, and a drain connected to a fourth node, the driving transistor configured to generate pixel current corresponding to a data voltage when a high-level source voltage is applied to the third node;

a light emitting element connected between the fourth node and an input terminal for a low-level source voltage;

an internal compensator including a first capacitor connected between the first node and a second node, and a second capacitor connected between the second node and an input terminal for the high-level source voltage, the internal compensator configured to control voltages of the first to fourth nodes in accordance with operations of a plurality of switching transistors in an initialization period, a data writing period and an emission period sequentially set with reference to a first scan signal, a second scan signal opposite to the first scan signal in phase, a third scan signal lagging the first scan signal in phase, and an emission signal; and a refresh transistor configured to apply the high-level source voltage to the second node in accordance with a fourth scan signal leading the first scan signal in phase in a refresh period preceding the initialization period.

2. The electroluminescent display device according to claim 1, wherein the refresh transistor includes:

a gate connected to an input terminal for the fourth scan signal;

a first electrode connected to the input terminal for the high-level source voltage; and a second electrode connected to the second node.

3. The electroluminescent display device according to claim 1, wherein the internal compensator is configured to apply an initialization voltage to the first node and the fourth node in the initialization period, the data voltage to the second node in the data writing period, and reflect a threshold voltage of the driving transistor in a gate-source voltage of the driving transistor in the emission period.

4. The electroluminescent display device according to claim 3, wherein the internal compensator further comprises:

a first switching transistor configured to connect the second node and the third node in accordance with the first scan signal, which has an ON level, in the initialization period, thereby applying a first voltage obtained by deducting a threshold voltage of the driving transistor from the initialization voltage to the third node;

a second switching transistor configured to apply the initialization voltage to the first node in accordance with the first scan signal, which has an ON level, in the initialization period;

a third switching transistor configured to apply the initialization voltage in accordance with the second scan signal, which has an ON level, in the initialization period;

a fourth switching transistor configured to apply the data voltage to the second node in accordance with the third scan signal, which has an ON level, in the data writing period; and a fifth switching transistor configured to disconnect electrical connection between the input terminal for the high-level source voltage and the third node in accordance with the emission signal, which has an OFF level, in the initialization period and the data writing period, and to electrically connect the input terminal for the high-level source voltage and the third node in accordance with the emission signal, which has an ON level, in the emission period.

5. The electroluminescent display device according to claim 4, wherein:

each of the first switching transistor, the second switching transistor, the fourth switching transistor, and the refresh transistor is embodied as an N-channel oxide transistor including an oxide semiconductor layer; and each of the third switching transistor, the fifth switching transistor, and the driving transistor is embodied as a P-channel low-temperature polysilicon (LTPS) transistor including an LTPS semiconductor layer.

6. The electroluminescent display device according to claim 4, wherein:

the second switching transistor is embodied as an N-channel oxide transistor including an oxide semiconductor layer; and each of the first switching transistor, the third switching transistor, the fourth switching transistor, the fifth switching transistor, the refresh transistor, and the driving transistor is embodied as a P-channel low-temperature polysilicon (LTPS) transistor including an LTPS semiconductor layer.

7. The electroluminescent display device according to claim 4, wherein:

each of the fourth switching transistor and the refresh transistor is embodied as an N-channel oxide transistor including an oxide semiconductor layer; and each of the first switching transistor, the second switching transistor, the third switching transistor, the fifth switching transistor, and the driving transistor is embodied as a P-channel low-temperature polysilicon (LTPS) transistor including an LTPS semiconductor layer.

8. The electroluminescent display device according to claim 4, wherein:

each of the first switching transistor, the second switching transistor, the third switching transistor, the fourth switching transistor, the fifth switching transistor, the refresh transistor, and the driving transistor is embodied as a P-channel low-temperature polysilicon (LTPS) transistor including an LTPS semiconductor layer.

9. The electroluminescent display device according to claim 1, wherein:

the first capacitor is configured to store the threshold voltage of the driving transistor in the initialization period; and the second capacitor is configured to store the data voltage in the data writing period.

10. The electroluminescent display device according to claim 1, wherein, when a first image frame and a second image frame, in which the data voltage is written in the pixels, are present, a plurality of third image frames, in which the data voltage written in the first image frame is maintained, is disposed between the first image frame and the second image frame.

* * * * *